US005913287A

United States Patent [19]

Csendes

[11] Patent Number: 5,913,287

[45] Date of Patent: Jun. 22, 1999

[54] METHOD AND APPARATUS FOR ENHANCING THE FLUIDIZATION OF FUEL PARTICLES IN COAL BURNING BOILERS AND FLUIDIZED BED COMBUSTION

[76] Inventor: Ernest Csendes, 514 Marquette St., Pacific Palisades, Calif. 90272-3314

[21] Appl. No.: 09/140,235

[22] Filed: Aug. 26, 1998

Related U.S. Application Data

[60] Provisional application No. 60/071,432, Jan. 14, 1998.

[51] Int. Cl.[6] ..... F22B 1/00

[52] U.S. Cl. ..... 122/4 D; 110/245

[58] Field of Search ..... 122/4 D; 110/245

[56] References Cited

U.S. PATENT DOCUMENTS

| | | |
|---|---|---|
| 4,203,391 | 5/1980 | Knoebel et al. . |
| 5,193,490 | 3/1993 | Peruski . |
| 5,343,830 | 9/1994 | Alexander et al. . |
| 5,730,071 | 3/1998 | Wasyluk et al. . |

*Primary Examiner*—Teresa Walberg
*Assistant Examiner*—Jiping Lu
*Attorney, Agent, or Firm*—Edward A. Sokolski

[57] ABSTRACT

Semi-permeable screens are installed in a pulverized coal burning boiler and rotatably driven by a high speed rotatable shaft. A first one of the screens is located above the main combustion zone of the boiler and a second one of the screens is located directly under the burnout zone of the boiler. The underside of the first rotating screen repels the larger and slower burning fuel particles that escape from the main combustion zone so that they are recycled for a complete burn-out. The smaller glowing particles suspended in the combustion gases pass through the first rotating screen and are micronized by the comminution effected by the spiral vortexes generated above this first screen. The second rotating screen positioned under the burnout zone provides for mixing and comminution of the gases and burning coal particles respectively. The vortexes generated by the screens homogenize the heat distribution in the upwardly moving stream of gas and solid particulates. The fuel may consist of micronized or pulverized particles or lumps of solids and may be combusted by itself or in admixture with sorbents for the flame scrubbing of $SO_x$ and $NO_x$.

10 Claims, 3 Drawing Sheets

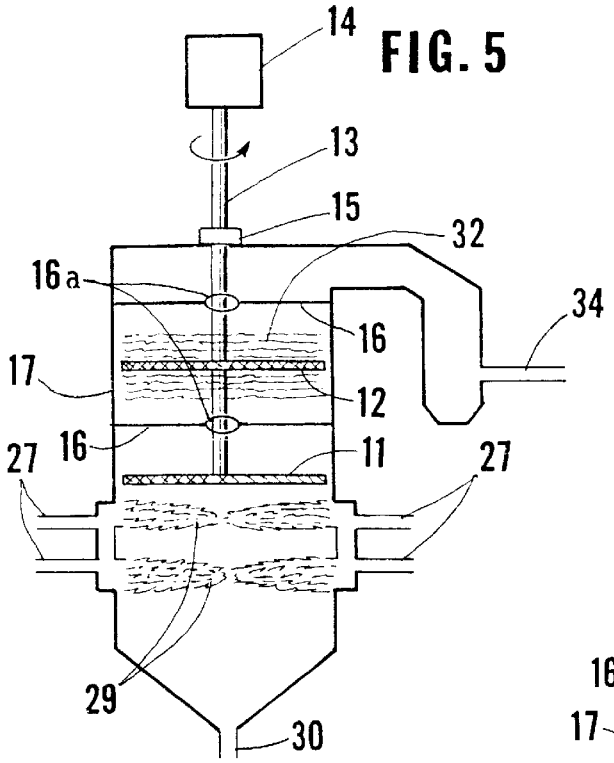
FIG. 5
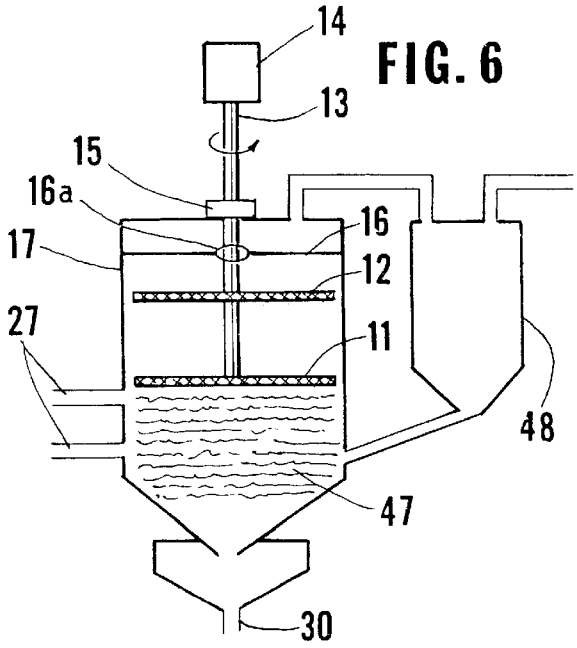
FIG. 6
FIG. 7
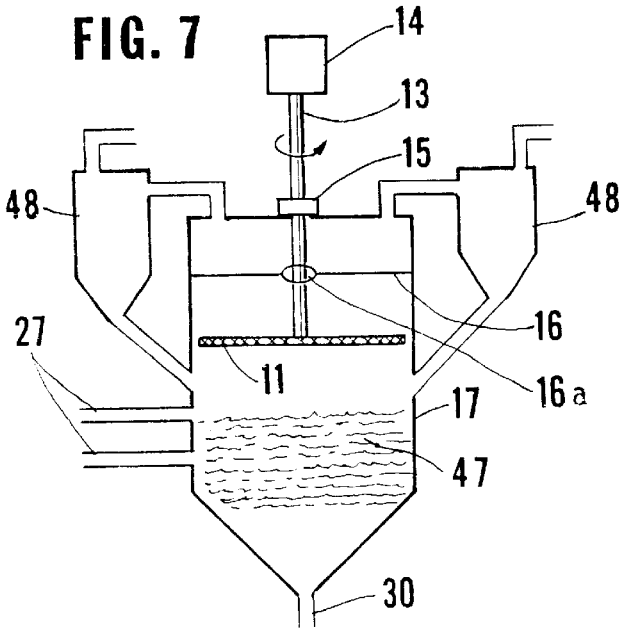

METHOD AND APPARATUS FOR ENHANCING THE FLUIDIZATION OF FUEL PARTICLES IN COAL BURNING BOILERS AND FLUIDIZED BED COMBUSTION

This application claims benefit of provisional application No. 60/071,432 filed Jan. 14, 1998.

BACKGROUND OF THE INVENTION

1. Field of the Invention

This invention relates to a method and apparatus for comminuting coal particles, by themselves or in mixture with a sorbent, in a coal burning boiler and more particularly to such a method and apparatus in which the larger particles are recycled and made finer for more efficient burning and flame scrubbing by sorbent particles to effect reduction of $SO_x$ and $NO_x$.

2. Description of the Related Art

In my U.S. Pat. No. 5,695,130 issued Dec. 9, 1997, the use of fast rotating screens with wide mesh openings(4–10 mesh) for comminuting solid particles of material such as coal and limestone is described. This end result is principally achieved by generating vortex grinding zones by means of the rotating screens into which the particles of the solid are driven by an upwardly moving gas stream. In my patent, the use of effective flame scrubbing for $So_x$ and $NO_x$ reduction by calcium carbide ($CaC_2$) is described, using a flame injection of micronized lime sorbent or a co-burning of micronized coal and micronized limestone.

In pulverized coal burning boilers, that burn coal of 70%-200 mesh, the larger particles in the coal(30% at 30–120 mesh) do not burn efficiently in the main combustion zone of the boiler, thereby resulting in heat losses and fouling of the boiler walls and convection passages. The coal for use in such boilers is generally prepared in roller mills which produce coal of 70%-200 mesh size from 2" lump coal feed. The smaller the particle size, the higher the combustion rate, many larger size particles escaping complete or even partial combustion in the main boiler combustion zone. When using low $NO_x$ burners that cause a staged combustion of the coal for effecting lower levels of $NO_x$ formation, a reducing atmosphere containing carbon monoxide is formed which damages the heat exchanger tubes, and if the carbon monoxide escapes the burnout zone of the boiler, heat loss and flue gas emission problems occur. Larger fuel particles escape unburned, lowering the boiler's thermal capacity. The fly ash produced with low $NO_x$ burners contains a high percentage (4% to 20%) of unburned coal, thereby causing loss of fuel, lower thermal yield in the boiler and a contaminated fly ash of lower economic value (high loss on ignition). Commercially available, such roller mills include the Raymond Roller Mill and the Babcock and Wilcox MPS Pulverizer.

Such prior art pulverized coal burning boilers are described, for example, in U.S. Pat. No. 5,343,830 issued Sep. 6, 1994 to Alexander, et al.

Micronized sorbents (limestone, dolomite) may be used for flame scrubbing the in situ formed $SO_x$ and $NO_x$ in the boiler, utilizing micronized or pulverized coal as a fuel. In circulating fluidized bed boilers, the fuel and sorbent may be in the form of pulverized particles or lump solids.

SUMMARY OF THE INVENTION

The device and method of the present invention overcomes the shortcomings of the prior art by employing fast rotating screens having wide mesh openings(4–10 mesh) in the boiler. These screens when used in a high velocity gas stream act to repel slower moving larger particles, thereby effecting their recycling. Further, the high speed rotating screens create vertical spiral vortexes thereabove by splitting the high velocity gas columns passing therethrough and concurrently twisting these split columns of gas. Passage of the upwardly gas-solid particulate stream through the rotating screens does not cause a pressure drop in such high velocity stream. Twisting of the air columns during said passage through the fast rotating screens produces a horizontal velocity component. This component causes a homogenization of the upwardly streaming gas and particulate solid mix, thereby providing an increased heat output in the boiler. In the preferred embodiment, a first rotating screen is mounted in the boiler above the main combustion zone of the boiler and recycles the larger particles of the fuel, sorbent and ash back to said combustion zone. The smaller particles which pass through the rotating screen are comminuted in spiral vortices formed above such screen. A second high speed rotating screen is located above the first screen. This second screen mixes the burning coal and sorbent particles and gas in this region and further comminutes said particles.

It is therefore an object of this invention to provide a method and apparatus for improving the burning of particulate fuel in a boiler and improving the $SO_x$ and $NO_x$ reduction in the flue gases or gasified fuel by the admixture of sorbents.

It is a further object of this invention to provide a method and apparatus for more effectively comminuting particulate fuel in a boiler and increasing the thermal yield of the boiler while lowering its maintenance costs.

Other objects of the invention will become apparent in view of the following description taken in connection with the accompanying drawings.

DESCRIPTION OF THE DRAWINGS

FIG. 5 is a schematic drawing of a third embodiment of the invention;

FIG. 6 is a schematic view of a fourth embodiment of the invention; and

FIG. 7 is a schematic view of a fifth embodiment of the invention.

DETAILED DESCRIPTION OF THE INVENTION

Figure 1:
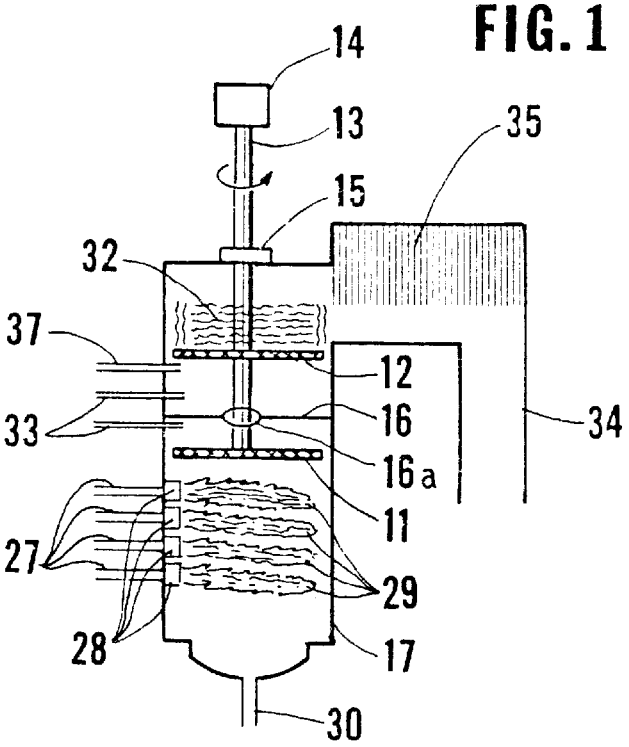
FIG. 1 is a schematic drawing illustrating a preferred embodiment of the invention.
Figure 2:
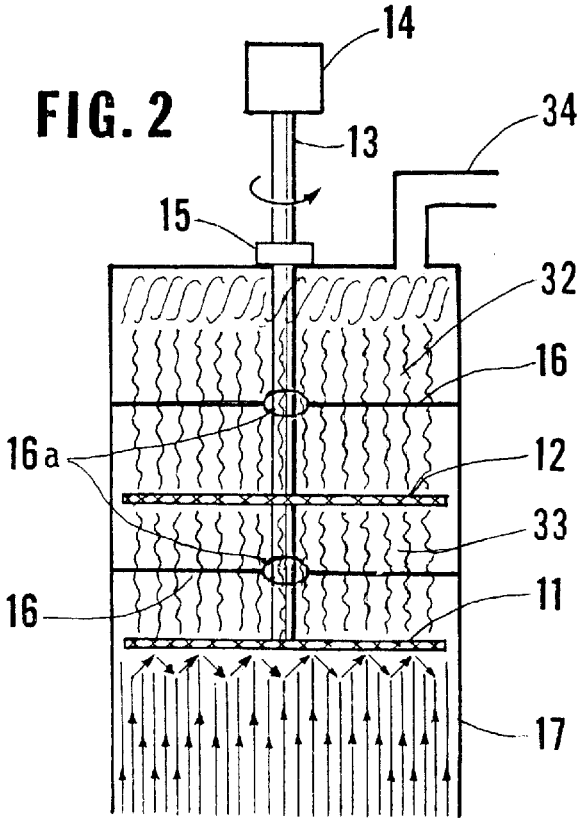
FIG. 2 is a schematic drawing illustrating the operation of the preferred embodiment.
Figure 3:
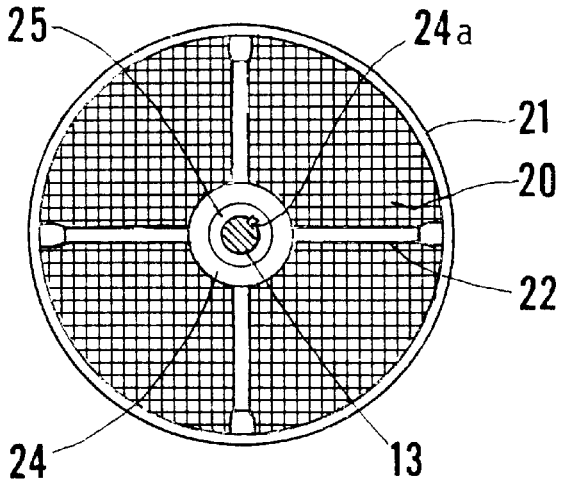
FIG. 3 is a schematic drawing illustrating one of the screens of the preferred embodiment.

Referring now to FIGS. 1–3, a preferred embodiment of the invention is illustrated.

Circular screens 11 and 12 are fixedly attached to shaft 13 which is rotatably driven by drive shaft 14. Shaft 14 is rotatably supported on bearing 15 which are mounted on the top wall of boiler 17. Further radial support for the drive shaft is provided by means of a guide ring structure 16 which is attached to the wall of the boiler and which has a circular sleeve portion 16*a* which surrounds the shaft 14. Shaft 14 is driven at a speed of 1,500–10,000 rpm.

Referring now to FIG. 3, the structure of screens 11 and 12 is illustrated. An abrasion resistant steel screen structure 20 having wide mesh openings(4–10 mesh size) is fixedly supported in holder frame 21. Radial reinforcing spokes 22 are attached at one end thereof to holder frame 21 and at the other end to central deflector disk 24. Formed in the center of deflector disk 24 is a hub 25 which is adapted to fit over shaft 13. A keyway 24*a* is formed in the hub of the deflector disk 24 which fits into a mating key slot formed in shaft 13. As shown in FIG. 2, any particles still remaining pass through convection heat transfer surfaces 35 for cooling prior to their exit through outlet 34.

Coal particles mixed with air are fed through fuel lines 27 into boiler 17. Before entering the boiler the air and coal particles are heated by means of burners 28 which are mounted on the walls of the boiler and serve to ignite and partially combust the fuel. This particle-air mixture enters the main combustion zone 29 of the boiler. The boiler has a bottom outlet 30 through which ash is disposed. Upper screen 12 is located beneath the burnout zone 32 of the boiler to fluidize the burning fine coal-gas mixture, or a mix of co-burning coal and scrubbing sorbent. Fuel for the reburn process for $NO_x$ reduction is fed into the boiler through inlets 33 with overfire air being fed in through inlet 37.

With reference to FIG. 2, the operation of the device of the invention is as follows. The underside of rotating screen 11 repels the larger and slower burning particles that escape from combustion zone 29, such particles being recycled for complete burnout. The smaller glowing coal particles suspended in the combustion gases pass through screen 11 and are exposed to the comminuting action of the spiral vortexes 33 generated above screen 11. Such particles, having been rendered soft at the flame temperature of the main combustion zone, are thus reduced in size and can pass through screen 12 into burnout zone 32. The particles in burnout zone 32 are further comminuted and mixed with the gas by the action of the spiral vortexes formed in this zone. Particles that still remain are fed out of the boiler through outlet 34 for further processing or collection. Lower screen 11 also provides the mixing and fluidization for injected sorbent in the boiler for the flame scrubbing of the in situ $SO_x$ and $NO_x$. The sorbent is injected either through fuel lines 27 as a mixture of fuel and sorbent or through reburn fuel line 33 as sorbent itself.

Figure 4:
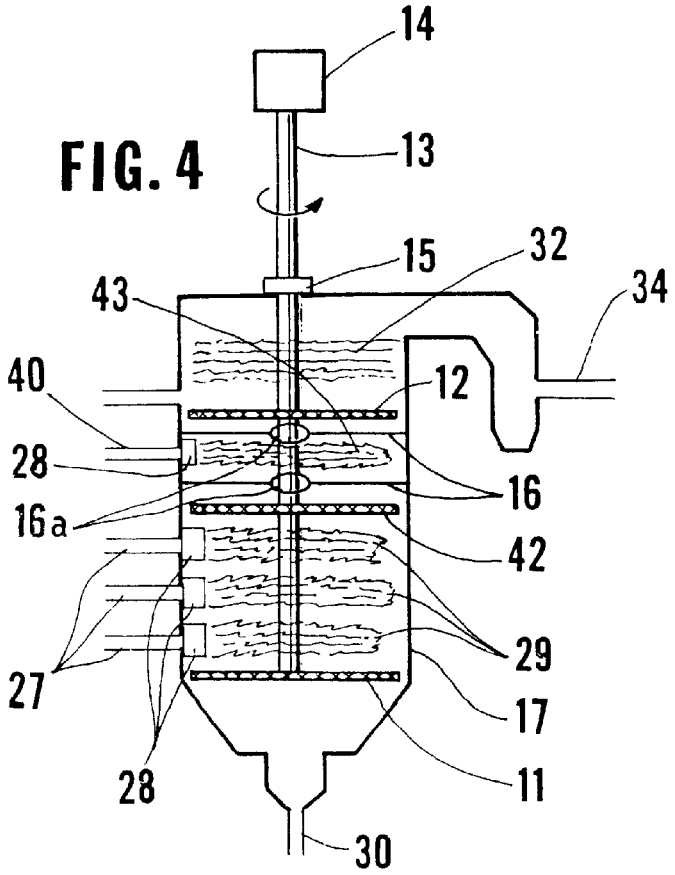
FIG. 4 is a schematic drawing of a second embodiment of the invention.

Referring now to FIG. 4, a second embodiment of the invention is illustrated, this embodiment being generally similar to the first embodiment but being adapted to operate with a boiler in which the reburn fuel is injected into the boiler to reduce $NO_x$ levels. In this embodiment, reburn fuel is introduced into the boiler through inlet 40 after having been heated by burner 28 through partial combustion. An additional rotating screen 42 similar to the screens 11 and 12 is provided under the "reburn zone" 43. Screen 42 comminutes the burning fuel particles and recycles the larger particles to the main combustion zone 29. This provides for a more effective use of the reburn fuel and decreases the $NO_x$ produced in the boiler in addition to increasing the thermal yield and lowering maintenance costs.

Referring now to FIG. 5, a third embodiment of the invention is illustrated. This embodiment is generally similar to the first embodiment but utilizes low $NO_x$ cell burners. Fuel is fed into main combustion zone 29 through inlets 27. As in the first embodiment, the rotating screen 11 operates to recycle the larger unburned coal particles and also comminutes the fly ash emitted. The second rotating screen 12 provides additional comminution of the burning fuel and fly ash particles and homogenizes the gases in the burnout zone 32.

Referring now to FIG. 6, a further embodiment of the invention generally similar to the first embodiment is shown. This embodiment constitutes a pressurized circulating fluidized bed system and employs a pair of rotating screens 11 and 12 as in the first embodiment. Screen 11 is positioned above fluidized bed 47 and recycles the coal, ash and sorbent particles that escape the turbulent bed back into bed 47. The fuel and ash particles and gas which pass through rotating screens 11 and 12 are comminuted by the vertical spiral vortexes above the screens and are carried by the gas stream into the hot cyclone 48 from where the solid particulates and tar are recycled into fluidized bed 47.

Referring to FIG. 7, a further embodiment of the invention generally similar to the first embodiment is shown. This embodiment is one that operates at atmospheric pressure and is a circulating fluidized bed system. Only a single fast rotating screen 11 is employed along with a pair of hot cyclones 48. The single rotating screen 11 operates as the previous embodiments to recycle larger particles back into fluidized bed 47 and to comminute the smaller particles passed through the screen in the spiral vortexes formed above the screen. High sulfur coal and limestone may be fed into the boiler through inlets 27. The particles are passed into hot cyclones 48 and from these cyclones the residual solids and tar are recycled into the fluidized bed 47.

While the invention has been described and illustrated in detail, it is to be clearly understood that this is intended by way of illustration and example only and not by way of limitation, the scope of the invention being limited only by the terms of the following claims.

I claim:

1. In a boiler utilizing fuel by itself or in mixture with a sorbent, in the form of pulverized or micronized particles or lump solids and including means for feeding said particles into said boiler and means for burning said particles, the improvement comprising:

a drive shaft rotatably mounted in said boiler;

means for rotatably driving said drive shaft at high speed; and at least one screen connected to said drive shaft for rotation therewith;

a combustion zone being formed in said boiler beneath said screen by said burning particles;

the underside of said screen repelling the larger particles back into said combustion zone for recycling;

smaller particles being suspended in the combustion gases and passing through said screen, spiral vortexes being generated above said screen which comminute said smaller particles with heated components in the upwardly streaming gas-solid particulate mix being homogenized by the rotating screen.

2. The boiler of claim 1 wherein the drive shaft is rotated at a speed of 1,500–10,000 rpm.

3. The boiler of claim 1 wherein the mesh of the screen is 4–10 mesh size.

4. The boiler of claim 2 wherein the mesh of the screen is 4–10 mesh size.

5. The boiler of claim 1 and further including a second screen similar to said first screen and connected to said drive shaft for rotation therewith, said second screen being located above said first screen and acting to further comminute said particles.

6. The boiler of claim 5 and additionally including a third screen similar to said first and second screens and connected to said drive shaft for rotation therewith, said third screen being located between said first and second screens and means for feeding reburn fuel into said boiler above said third screen.

7. The boiler of claim 1 and further including hot cyclone means through which the comminuted particles are passed from the boiler and recycled back into said boiler.

8. A method for improving the combustion of particulate fuel in a boiler comprising:

feeding particulate fuel material by itself or in mixture with a sorbent into said boiler;

burning said particulate material in a combustion zone of said boiler; and rotatably driving a screen at high speed above said combustion zone to repel larger particles of said particulate material back into said combustion zone with smaller particles of said material passing through said screen;

spiral vortexes being formed above said screen which operate to comminute the particles passing therethrough, heat components in the upwardly streaming gas-solid particulate mix being homogenized by the rotating screens.

9. The method of claim 8 wherein said screen is rotated at 1,500–10,000 rpm.

10. The method of claim 8 wherein a second screen positioned above the first screen is rotatably driven at high speed, said second screen further comminuting the particles passing therethrough.

* * * * *